United States Patent [19]

Griswold

[11] 4,044,564

[45] Aug. 30, 1977

[54] TRENCH SHORING ASSEMBLY WITH CORNER GUARD ACCESSORY

[76] Inventor: James L. Griswold, 513 Morningside Drive, Battle Creek, Mich. 49015

[21] Appl. No.: 656,147

[22] Filed: Feb. 9, 1976

[51] Int. Cl.[2] ..... E21D 5/00; E02F 9/28

[52] U.S. Cl. ..... 61/41 A; 37/142 R

[58] Field of Search ..... 61/41 A; 37/142 R, 86, 37/103

[56] References Cited

U.S. PATENT DOCUMENTS

| | | | |
|---|---|---|---|
| 3,593,528 | 7/1971 | Pavese | 61/41 A |
| 3,623,247 | 11/1971 | Stepe | 37/142 R |
| 3,782,125 | 1/1974 | Holl | 61/41 A |
| 3,864,921 | 2/1975 | Marx et al. | 61/41 A |
| 3,937,026 | 2/1976 | Krings | 61/41 A |

*Primary Examiner*—Jacob Shapiro

*Attorney, Agent, or Firm*—McGlynn and Milton

[57] ABSTRACT

This invention relates to a trench shoring assembly which includes a pair of spaced-apart side walls for vertical disposition within a trench. Spreader pipes and spreader collars interconnect the side walls and allow limited pivotal movement between the side walls. Each side wall includes outer and inner metal plates connected to a horizontally extending hollow top beam which extends longitudinally along the top of the side wall, two intermediate beams parallel the hollow metal beam and a bottom beam. A hardwood insert is disposed within the top beam to prevent the collapse of the hollow metal beam. A number of hollow beams extend perpendicularly to the horizontal beams and ribbed members extend perpendicularly to the horizontal beams. The side walls of the assembly have a tapered bottom portion which defines a triangularly shaped pointed lower extremity extending between the ends of the bottom portion. A metallic bar is disposed at the pointed lower extremity and extends between the ends of the bottom portion and protects the bottom of the side wall against abrasion. A U-shaped member is welded to the main frame, and, in turn, a spreader collar is welded to the U-shaped member so that a force applied to the spreader collar is transferred directly to the main frame. Each spreader pipe spaces the side walls apart between two spreader collars to which the spreader pipe is attached by spreader pins. Lifting rings are slidably attached to the spreader pipes for lifting the assembly. A plurality of flanges extend from a spreader pipe and are connected by locking pins to mating flanges which extend from another spreader pipe of another vertically stacked trench shoring assembly.

8 Claims, 10 Drawing Figures

TRENCH SHORING ASSEMBLY WITH CORNER GUARD ACCESSORY

BACKGROUND OF THE INVENTION

This invention relates to trench shoring assemblies provided with abrasion protective accessories and, in particular, to a type of trench shoring assembly known as a trench box with an abrasion protective means positioned at the lower ends of the trench box.

Trench boxes are trench shoring assemblies used in excavation work when pipe or conduit is being laid. Basically, a trench box includes two side walls spaced apart a fixed distance from each other by a plurality of spreader pipes affixed to and perpendicular to each side wall. Assembled trench boxes are positioned in an excavation hole or trench and pipe is laid within the trench box, and after each length of pipe is laid the trench box is moved along the trench for laying the next length of pipe. The side walls of the trench box keep the excavation area free from earth which may fall or cave into the excavated hole or trench during or before the laying of the pipe.

Trench boxes are dragged across roads or other hard surfaces as they are shifted from one excavation area to another or as they are moved along the trench. This shifting causes the lower ends of the trench box to receive the greatest amount of wear and abuse thereby damaging the bottom of the trench box.

In accordance with the present invention and in order to resist wear and reduce distortion at the trench box ends, a trench shoring assembly of the type including a pair of interconnected spaced side wall means is provided with each side wall means having a tapered bottom portion defining a triangularly shaped pointed lower extremity and guard means disposed at least at one of the ends of the pointed lower extremity for protecting that end from abrasion.

Other advantages of the present invention will be readily appreciated as the same becomes better understood by reference to the following detailed description when considered in connection with the accompanying drawings wherein.

DESCRIPTION OF THE PREFERRED EMBODIMENT

Figure 1:
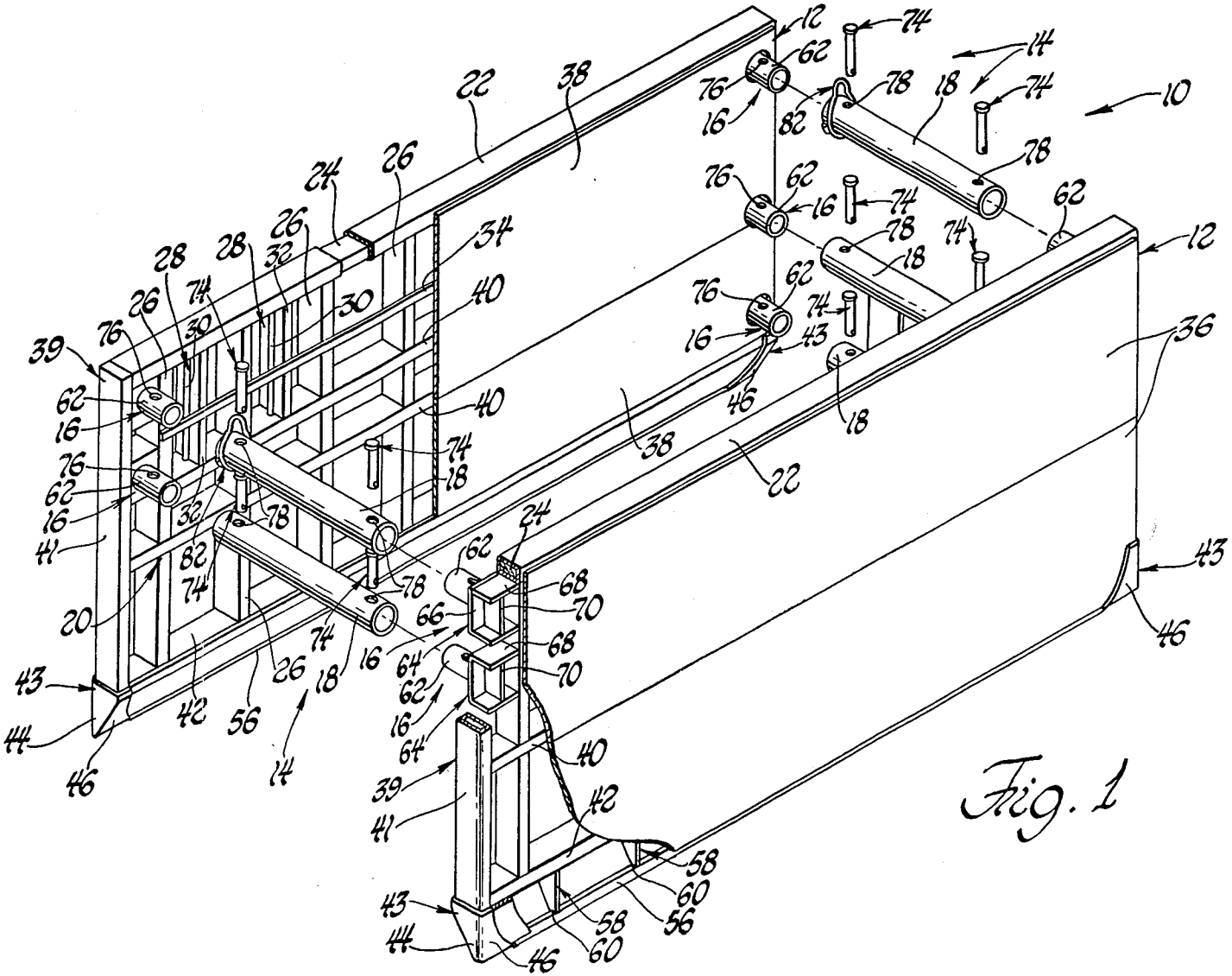
FIG. 1 is a perspective view partially broken away and in cross section of a trench shoring assembly constructed in accordance with the subject invention.
Figure 2:
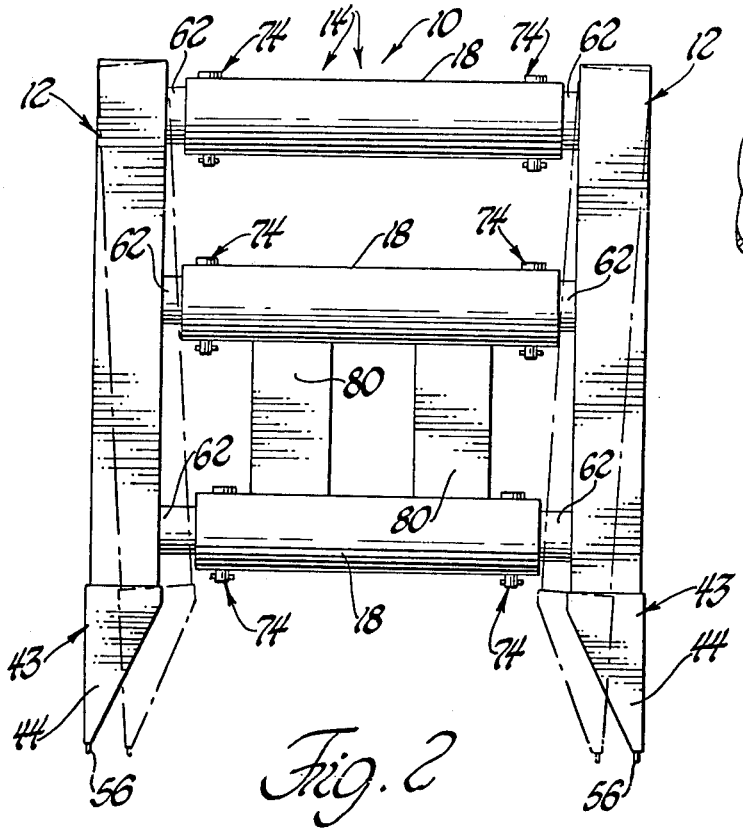
FIG. 2 is a front view of the trench shoring assembly showing relative movement between the side walls and the connecting means in phantom.

Referring now to the drawings, a trench shoring assembly or trench box assembly constructed in accordance with the subject invention is generally shown at 10 in FIGS. 1 and 2. The trench box assembly 10 includes a pair of identically constructed spaced wall means or side walls each generally indicated at 12. The side walls 12 are disposed vertically within a trench to prevent cave-in of the side walls of the trench or hole as pipe is laid between the side walls 12.

The trench box assembly 10 also includes connecting means generally shown at 14 for allowing limited pivotal movement between the side walls 12. The limited pivotal movement allowed between the side walls 12 is illustrated in phantom in FIG. 2. The connecting means 14 includes support means generally shown at 16 which are rigidly attached to each of the side walls 12. Spreader means comprising the cylindrical spreader device or pipes 18 extend between the support means 16 and space the side walls 12 apart.

As illustrated in FIG. 1, each side wall 12 is defined by interconnected structural members which define a main frame generally indicated at 20. Many of the structural members defining the frame 20 are hollow metal beams generally rectangular in cross section with rounded corners. One of the hollow structural metal beams is a top beam 22 which extends longitudinally along the top of each side wall 12. A force transferring means such as a hardwood insert 24 is disposed within the top beam 22 for preventing the collapse of the top beam 22. When the trench box assembly 10 is placed in a trench, the top of the side walls 12 are pounded to drive the side walls into the earth. The hardwood insert 24, which could be made of other equivalent materials, prevents the collapse of the top beam 22 and transfers such forces to the remaining frame members.

The frame 20 further includes vertical hollow beams 26 which extend perpendicularly to and are connected to the top beam 22 and transfer the above-described pounding forces to the lower structural members. The frame also includes the solid ribbed plate members or ribbed members generally shown at 28 and which also extend perpendicularly to and are connected to the top beam 22. The ribbed plate member 28 provides additional structural support to the side walls 12 and are optional. Each ribbed plate member 28 includes a vertically extending ribbed portion 30 extending perpendicularly to the top beam 22 and a flanged portion 32 extending perpendicularly from the ribbed portion 30. A metal strip member 34 is attached by welding to the flanged portions 32 of adjacent ribbed members 28 to interconnect the ribbed members 28. The strip member 34 is also welded to the vertical beams 26.

A metal plate means is connected to the frame 20 at its inner and outer face. More particularly, the metal plate means includes one or more outer metal plates 36 and one or more inner metal plates 38 welded to the structural members of the frame 20, thereby rendering the interior of a side wall 12 airtight.

The strip member 34 which is disposed approximately midway between the ends of the ribbed members 28, provides a greater surface area to which the upper inner metal plate 38 may be welded.

The frame 20 also includes intermediate horizontally extending beam members 40. The intermediate beam members 40 extend parallel to the top beam 22 and perpendicular to the vertical beams 26 to provide added structural strength to the frame 20. The ends of the side walls 12 are defined by vertically disposed hollow beam members generally shown at 39 which extend from the top of each side wall 12 to the top of the triangular bottom portion or lower extremity. These vertical structural members 39 are also generally rectangular in cross section and have rounded corners. The metal plates 36 and 38 are welded to the side of the vertical structural member 39, the edge of the metal plates 36 and 38 being disposed rearwardly from the end face 41 of the vertical structural member 39 as shown in FIG. 10.

Figure 5:
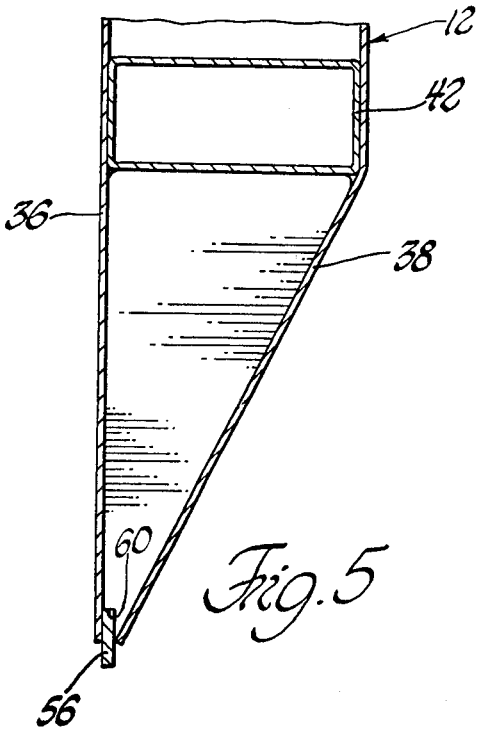
FIG. 5 is a fragmentary cross-sectional view showing the lower extremity of a side wall.

As seen in cross section in FIG. 5, each side wall 12 has a tapered bottom portion which defines a triangularly shaped pointed lower extremity. This pointed lower extremity extends between the ends of the side walls 12. One of the structural members of the main frame 20 is a horizontally extending bottom beam member 42 which extends horizontally along the bottom of the side wall 12 and above the triangularly shaped pointed lower extremity. A portion of the lower outer metal plate 36 extends vertically downwardly from the horizontally extending bottom beam member 42 and forms one side of the triangularly shaped pointed lower extremity. The bottom extremity of the lower inner metal plate 38 is bent inwardly to define the other side of the triangularly shaped lower extremity to thereby complete the triangular shape.

The trench box assembly 10 further includes guard means, such as corner shoes generally shown at 43 in FIGS. 1 and 2, which are disposed at each of the bottom corners or ends of the side walls 12. The corner shoes 13 are disposed at and encase each of the bottom ends of the side walls 12 thereby providing these bottom ends with protection against abrasion. The corner shoes 43 are made of cast or forged metal to provide the necessary durability to resist wear, as these corner ends of the side wall 12 often receive the greatest amount of wear due to dragging the trench box assembly 10 over rough surfaces such as gravel. The corner shoes 43 are comprised of a triangular member having a triangular front face 44 and side flanges 46 which extend rearwardly from the front face 44 along two sides of the front face 44. The two side flanges 46 come together at the bottom of the corner shoe to form a knife-like cutting edge to allow the lower extremity of the trench box assembly 10 to be more easily positioned into the ground. The side flanges 46 are disposed in overlapping relationship to the metal plates 36 and 38 and are disposed exteriorly of the metal plates 36 and 38. The corner shoes 43 are welded to the vertical beam 39 and the metal plates 36 and 38.

Figure 9:
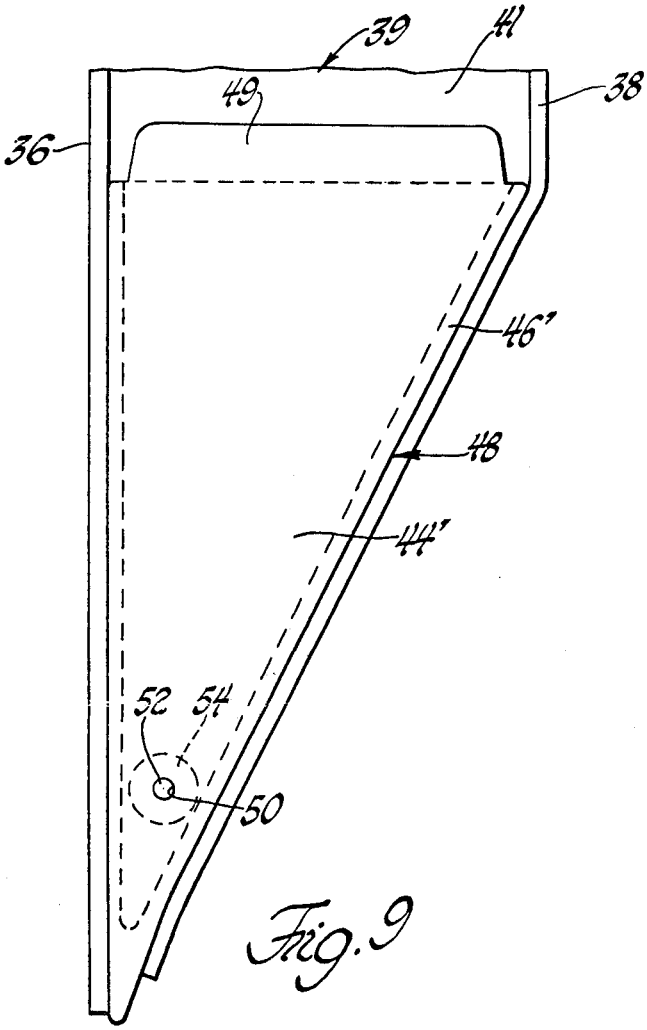
FIG. 9 is a fragmentary end view of the bottom end of a side wall showing a guard means disposed on the end of the lower extremity of the wall means.
Figure 10:
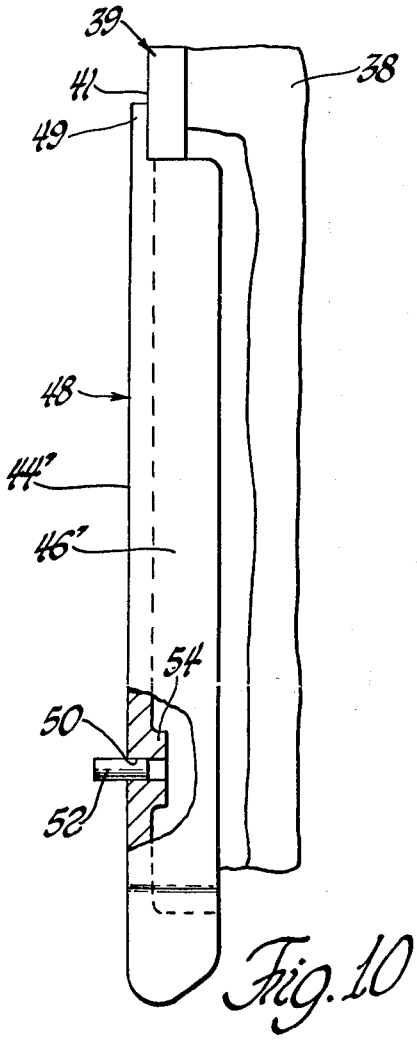
FIG. 10 is a fragmentary, cross-sectional, side view of the guard means of FIG. 9 disposed on the end of the lower extremity of the wall means.

Instead of corner shoes 43, the guard means may comprise an end gusset such as that generally shown at 48 in FIGS. 9 and 10. The end gusset 48 also includes a triangular front face or wall 44' and side flanges 46' which extend rearwardly from the front face 44' along two sides of the end gusset 48. The side flanges 46' of the end gussets 48 are disposed in overlapping relationship with the metal plates 36 and 38 and the side flanges 46' are disposed interiorly of the metal plates 36 and 38. The end gussets 48 also include a tongue 49 extending upwardly from the front wall 44' for overlapping the lower end of the adjacent vertical beam 39.

The end gusset 48 has a threaded hole 50 through the front face or wall 44', the hole 50 being in fluid communication with the interior of the side wall 12. As shown in FIGS. 9 and 10 removable plug means comprising a plug 52 is threadedly disposed in the hole 50 to prevent the flow of any fluid through the hole 50. The side walls 12 are fabricated so as to be watertight, however, they may, after wear and tear, leak. As alluded to above, both the corner shoes 43 and the end gussets 48 are welded in watertight relationship to the vertical beams 39 and the metal plates 36 and 38. If water leaks into the side wall 12, the plug 52 may be removed to enable the water to drain out through the hole 50. The end gusset 48 is provided with a raised boss 54 at the back surface of the front face 44' and the hole 50 extends through the boss 54 to establish fluid communication with the interior of the side wall 12.

An abrasion protection means or metallic bar 56 is disposed at the pointed lower extremity of the side walls 12 and extends between the ends of the side wall 12. The metallic bar 56 protects the bottom of the side wall 12 against abrasion and preferably comprises "Suralloy 500" an 8630 modified steel. A plurality of triangularly shaped gusset plates, generally shown at 58, are horizontally spaced along the lower extremity and extend downwardly from the horizontally extending bottom beam member 42 to a pointed lower end. The pointed lower end of each gusset plate 58 has a notch 60 formed therein in which the metallic bar 56 is disposed. The gusset plates 58 are welded to and hold the metallic bar 56 at a number of positions along the lower extremity of the side wall 12 and the metallic bar 56 is also welded to and disposed between the outer metal plate 36 and the inner metal plate 38.

As described above, each side wall 12 includes interconnected structural members which define a main frame 20. The support means 16 is rigidly secured to the main frame 20 and is adapted to be connected to the spreader pipes 18 for transferring forces from the spreader pipes 18 directly to the main frame 20. The support means 16 includes a collar means or tubular spreader collar 62 and a backing plate means generally indicated at 64 in FIG. 1. The spreader collars 62 extend from the side walls 12 and are adapted to be connected to the spreader pipes 18, the spreader pipes 18 extending between a pair of opposed tubular spreader collars 62. The backing plate means 64 rigidly secures the spreader collars 62 to the main frame 20 whereby forces applied to the spreader collars 62 are transferred directly to the main frame 20. The backing plate means 64 includes a U-shaped member having a front wall 66 and spaced side flanges 68 which extend rearwardly from the front wall 66. The spreader collar 62 is welded to the front wall 66 and the side flanges 68 are welded to the main frame 20. The side flanges 68 extend rearwardly from the front member 66 along the top and bottom sides of the front wall 66. The upper side flange 68 of the upper U-shaped member adjacent the top beam 22 is welded to the front wall 66 and extends rearwardly. The side flanges 68 are rigidly secured to the main frame 20 and, in particular, to the verticle beam 39 and one of the verticle beams 26 by welding. The backing plate means 64 further includes rib means comprising plates or support ribs 70 which extend vertically between and are welded to the side flanges 68 for maintaining the position of the side flanges 68 relative to each other as shown in FIG. 1. The edge of the walls 66 and the flanges 68 are welded to the beam members of the frame 20. By providing so many welding points the U-shaped member and, consequently, the entire support means 16, is rigidly secured to the side wall 12 at its main frame 20.

Figure 3:
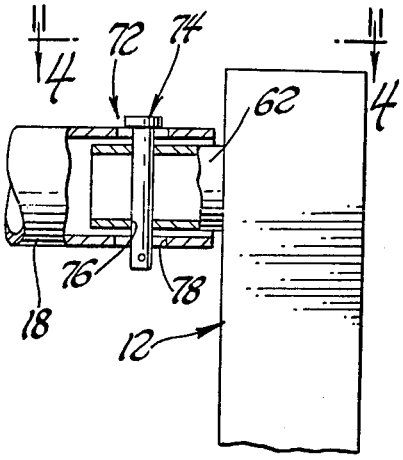
FIG. 3 is a fragmentary view partially broken away and in cross section showing the interconnection between a spreader pipe and a support means.
Figure 4:
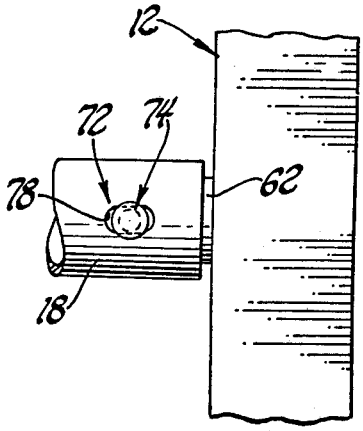
FIG. 4 is a fragmentary view taken substantially along line 4—4 of FIG. 3 and particularly showing the elongated slot formed in the spreader pipe.

The ends of the spreader pipes 18 overlap a portion of the spreader collars 62 as best illustrated in FIGS. 2, 3 and 4. The connecting means 14 includes a slot means generally indicated at 72 extending through the overlapping portions of the spreader pipes 18 and the spreader collars 62 as best illustrated in FIG. 4. Pin means generally indicated at 74 extend through the slot means 72 and attach the spreader pipes 18 to the spreader collars 62. As shown in FIG. 4, the slot means 72 is larger in part than the pin means 74 and allows the relative pivotal movement between the spreader collars 62 and the spreader pipes 18. In other words, the pin means 74 is allowed to move unencumbered to a limited extent along the slot means 72 in allowing the relative pivotal movement between the spreader pipes 18 and spreader collars 62. The slot means 72 includes a hole 76 extending through each spreader collar 62 and an elongated slot 78 which extends through the spreader pipes 18. The pin means 74 extend through both holes 76 and elongated slots 78 and thereby attaches the spreader pipes 18 to the spreader collars 62.

A brace means comprising a pair of horizontally spaced structural beams or plates 80 shown in FIG. 2 rigidly interconnect two adjacent spreader pipes 18. The plates 80 which extend vertically between the vertically spaced spreader pipes 18 are provided because the limited pivotal mevement between the spreader pipes 18 and the spreader collars 62 causes the spreader pipes 18 to act as levers to produce a bending action on the spreader collars 62 which could break the spreader collars 62 off their respective backing plate means 64. The plates 80 tie two spreader pipes 18 together, the tied together spreader pipes 18 thereby exerting a straight pull or push action on the corresponding spreader collars 62 and not a bending action.

Figure 6:
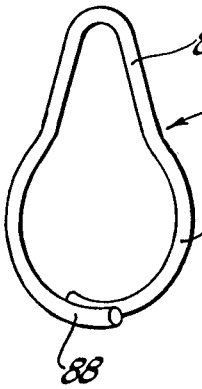
FIG. 6 is a front view of a ring member or lifting ring.
Figure 8:
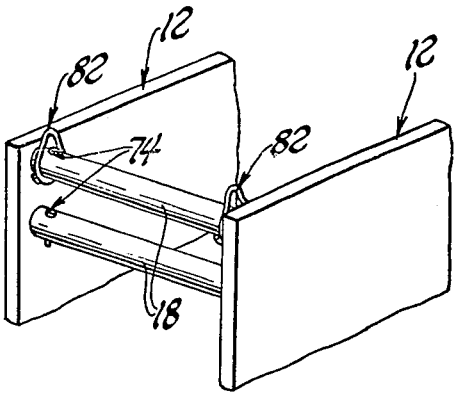
FIG. 8 is a fragmentary perspective view showing the lifting rings attached to the connecting means for lifting the trench shoring assembly.

As shown in FIG. 1 and in FIG. 8, lifting means comprising closed loop ring members generally shown at 82 are supported by the spreader pipes 18 and are provided for lifting the trench box assembly 10 upon being connected to a raising means such as a hook on a cable extending from a crane. The ring members 82 are slidably supported by the spreader pipes 18 so that the ring members 82 may be positioned at a number of positions along the spreader pipes 18. As can be best seen in FIG. 6, the ring members 82 include a large radius portion 84 which engages the spreader pipe 18 and a smaller radius portion 86 which may be connected to the hook on a cable extending from the crane. Each of the ring members 82 may be formed by bending a metal rod into the configuration shown until its ends 88 overlap. The overlapping ends 88 are welded together. These overlapping ends 88 are disposed along the large radius portion 84.

As previously noted, the pin means 74 interconnects the spreader pipes 18 and the spreader collars 62. The pin means 74 also limits the movement of the ring members 82 by only permitting the ring members 82 to move between themselves and their corresponding adjacent side wall 12 along the spreader pipes 18.

Figure 7:
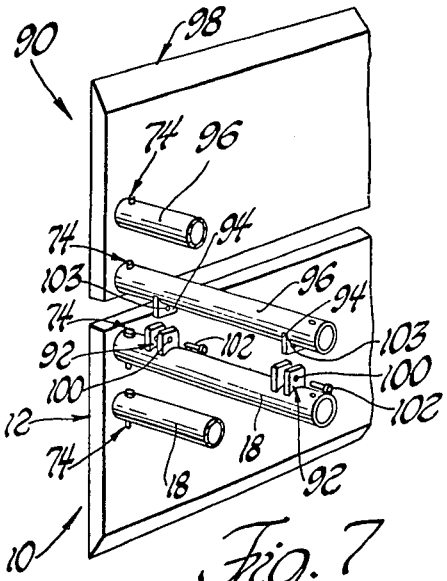
FIG. 7 is a fragmentary perspective view showing lug means interconnecting a set of stacked side walls.

FIG. 7 shows a second box assembly, generally shown at 90, stacked upon the identical trench box assembly 10. Lug means such as a plurality of flanges generally shown at 92 extend from the top-most spreader pipe 18 for attachment to mating lug means such as mating flanges 94 which extend from a cylindrical spreader pipe 96 of a second connecting means. The second connecting means is associated with a second pair of side walls generally shown at 98, only one of which is shown in FIG. 7. The flanges 92 have holes 100 therethrough for receiving locking pins 102 to interconnect the flanges 92 with the mating flanges 94 when the flanges 92 and 94 are aligned, the mating flanges 94 having holes 103 therethrough to also receive the locking pins 102. The flanges 92 include a pair of closely spaced flanges while the mating flanges 94 comprise a single flange 94 which is disposed between the closely spaced flanges 92. The locking pin 102 extends through the closely spaced flanges 92 and the single flange 94 to interconnect the flanges and, thereby interconnect the stacked trench box assemblies 10 and 90 at spreader pipes 18 and 96 respectively.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims, the invention may be practiced otherwise than as specifically described.

The embodiments of the invention in which an exclusive property or privilege is claimed are defined as follows:

1. A trench shoring assembly of the type including a pair of interconnected spaced wall means, said assembly comprising: wall means having a predetermined thickness and a tapered bottom portion defining a triangularly shaped pointed lower extremity extending between the ends thereof, and guard means disposed at least at one of said ends of said lower extremity for providing protection against abrasion, said tapered bottom portion of said wall means including metal plate means diverging upwardly from said pointed lower extremity, said guard means comprising a triangular member having a triangular front face extending transversely to and between said metal plate means and flanges extending rearwardly from said front face and disposed in lapping relationship with said metal plate means, said guard means being of a higher abrasion resistance than said metal plate means.

2. An assembly as set forth in claim 1 wherein said guard means is one of cast metal and forged metal.

3. An assembly as set forth in claim 1 wherein said guard means has a hole through said front face thereof and removable plug means disposed in said hole.

4. An assembly as set forth in claim 3 including a raised boss providing an increased thickness of said front face, said hole extending through said boss.

5. An assembly as set forth in claim 1 wherein said side flanges are disposed exteriorly of said metal plate means.

6. An assembly as set forth in claim 1 wherein said side flanges are disposed interiorly of said metal plate means.

7. An assembly as set forth in claim 6 wherein said front face includes a tongue extending above the upper extremities of said side flanges.

8. An assembly as set forth in claim 1 wherein said wall means comprises a plurality of interconnected structural members and said metal plate means is secured thereto, said ends of said wall means being defined by a vertically disposed structural member extending from the top of said wall means to the top of said tapered bottom portion, said vertical structural member being generally rectangular in cross section with rounded corners, said metal plate being welded to said vertical structural member with the edge thereof disposed rearwardly from the end face of said vertical structural member, said front face of said guard means being disposed in overlapping relationship with the bottom portion of said end face of said vertical structural member.

* * * * *